US008626045B2

(12) United States Patent
Matsuura et al.

(10) Patent No.: US 8,626,045 B2
(45) Date of Patent: Jan. 7, 2014

(54) FIXING DEVICE FOR FIXING TONER IMAGE ON RECORDING MEDIUM AND IMAGE FORMING APPARATUS INCLUDING THE SAME

(75) Inventors: Kuniya Matsuura, Toyohashi (JP); Takayuki Ito, Nagoya (JP); Shigeru Tashiro, Toyokawa (JP); Noboru Oomoto, Toyokawa (JP); Masayuki Satou, Toyohashi (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 187 days.

(21) Appl. No.: 13/045,673

(22) Filed: Mar. 11, 2011

(65) Prior Publication Data

US 2011/0229222 A1 Sep. 22, 2011

(30) Foreign Application Priority Data

Mar. 19, 2010 (JP) ..... 2010-064590

(51) Int. Cl.
*G03G 15/20* (2006.01)

(52) U.S. Cl.
USPC ..... 399/328

(58) Field of Classification Search
USPC ..... 399/122, 320, 325, 327–330, 334
See application file for complete search history.

(56) References Cited

U.S. PATENT DOCUMENTS

| | | | | |
|---|---|---|---|---|
| 4,248,520 | A * | 2/1981 | Kurita et al. | 399/92 |
| 5,903,810 | A * | 5/1999 | Adachi | 399/328 |
| 7,187,899 | B2 * | 3/2007 | Cao et al. | 399/328 |

FOREIGN PATENT DOCUMENTS

| | | | |
|---|---|---|---|
| JP | 5-188805 | A | 7/1993 |
| JP | 9-101700 | A | 4/1997 |
| JP | 2003215962 | A | 7/2003 |
| JP | 2004-287318 | A | 10/2004 |
| JP | 200591522 | A | 4/2005 |
| JP | 2007-086452 | A | 4/2007 |

OTHER PUBLICATIONS

Japanese Office Action, with English-language translation, dated Jan. 31, 2012.

* cited by examiner

*Primary Examiner* — Clayton E Laballe
*Assistant Examiner* — Victor Verbitsky
(74) *Attorney, Agent, or Firm* — Buchanan Ingersoll & Rooney PC

(57) ABSTRACT

A fixing device fixes a toner image on a recording medium. In the fixing device, a heating unit heats a recording medium. A pressing unit presses a recording medium in pressure contact with the heating unit. The heating unit and the pressing unit are accommodated in a casing. A heat reflecting unit is provided between the heating unit and the casing. An intermediate member is provided between the heating unit and the heat reflecting unit.

10 Claims, 5 Drawing Sheets

FIXING DEVICE FOR FIXING TONER IMAGE ON RECORDING MEDIUM AND IMAGE FORMING APPARATUS INCLUDING THE SAME

This application is based on Japanese Patent Application No. 2010-064590 filed with the Japan Patent Office on Mar. 19, 2010, the entire content of which is hereby incorporated by reference.

BACKGROUND OF THE INVENTION

1. Field of the Invention

The present invention relates to a fixing device for fixing a toner image formed on a recording medium, and an image forming apparatus including the fixing device.

2. Description of the Related Art

In an electrophotographic image forming apparatus, a photoconductor drum is charged almost uniformly and is then exposed, for example, by a laser scanning unit to form an electrostatic latent image in accordance with an image signal. Thereafter, toner charged by a developing unit is supplied to the photoconductor drum to form a visual image. The resultant toner image is transferred to a recording medium such as transfer paper. Since the toner image transferred on the recording medium is only carried on the recording medium and has not yet been fixed, the toner image is heated and pressed by a fixing device included in the image forming apparatus, and thus thermally fused and fixed. Accordingly, an image fixed on the recording medium is formed. In such a fixing device, a toner image on a recording medium is fixed on a heating roller.

A variety of techniques have been disclosed for reducing energy consumption in a fixing device by reducing energy required to heat a heating roller.

For example, Document 1 (Japanese Laid-Open Patent Publication No. 05-188805), Document 2 (Japanese Laid-Open Patent Publication No. 09-101700), and Document 3 (Japanese Laid-Open Patent Publication No. 2007-086452) disclose a fixing device including a heating roller in a resin housing, in which a heat reflecting plate for bringing more heat from the heating roller back to the heating roller is provided between the resin housing and the heating roller.

Document 4 (Japanese Laid-Open Patent Publication No. 2004-287318) discloses a fixing device including, in addition to a heat reflecting plate as described above, a cleaner for cleaning a surface of a heating roller to prevent reduction of durability of the heating roller. According to those techniques, heat radiated from a heating roller is returned to the heating roller by a heat reflecting plate, so that energy required to heat the heating roller can be reduced.

However, as the conventional fixing device as disclosed in Documents 1 to 3 is used over time, toner or wax contained in toner and paper dust adhere to the surface of the heat reflecting plate to reduce heat reflecting efficiency. When a cleaner is provided in a fixing device as disclosed in Document 4, the complicated structure increases the cost of the fixing device.

SUMMARY OF THE INVENTION

The present invention has been conceived in view of those situations. An object of the present invention is to provide a fixing device in which energy required to heat a heating roller is reduced while its production costs are kept low.

A fixing device in accordance with the present invention fixes a toner image on a recording medium. The fixing device includes a heating unit for heating a recording medium, a pressing unit for pressing a recording medium in pressure contact with the heating unit, a casing for accommodating the heating unit and the pressing unit, a first heat reflecting unit provided between the heating unit and the casing, and a first intermediate member provided between the heating unit and the first heat reflecting unit.

An image forming apparatus in accordance with the present invention forms an image on a recording medium and includes the fixing device as described above.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
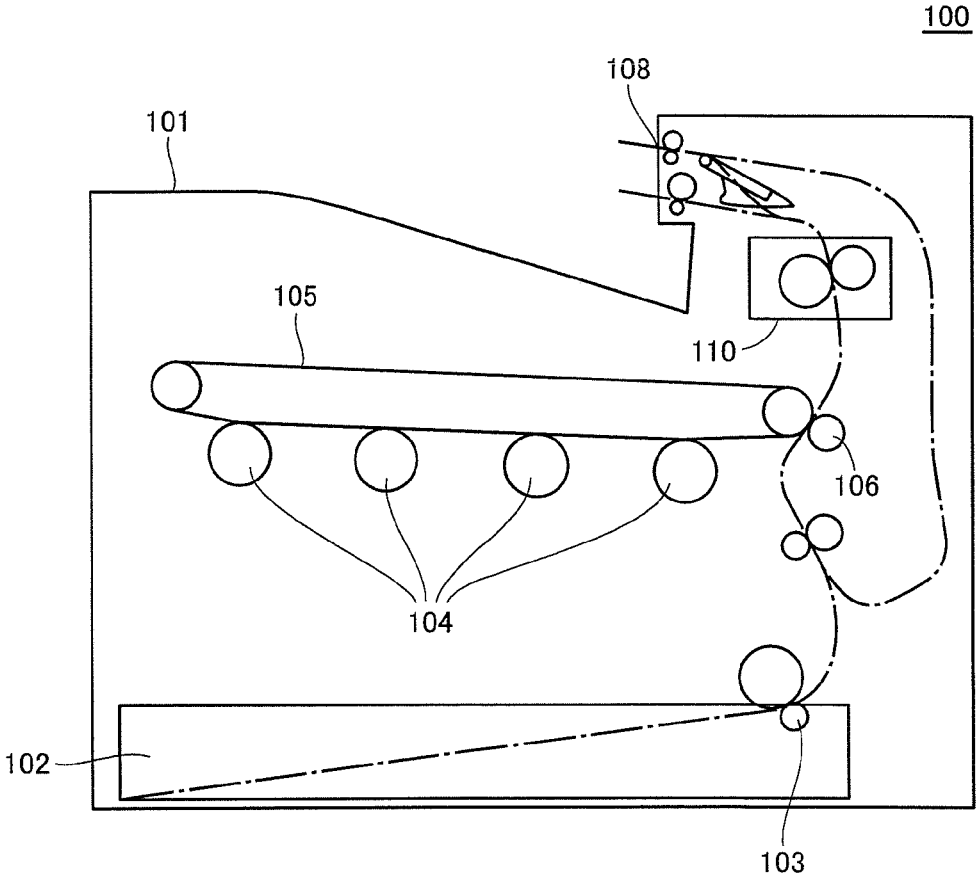
FIG. 1 is a diagram illustrating a structure of an image forming apparatus including a fixing device in accordance with an embodiment of the present invention.

In the following, an embodiment of the present invention will be described with reference to the drawings. It is noted that in the figures the same components having the same functions are denoted with the same reference characters, and a description thereof will not be repeated.

In the present embodiment, a tandem color printer forming a color image is shown as an example of an image forming apparatus. It should be noted that the image forming apparatus in accordance with the present invention may be a monochrome printer or any other printer as long as it includes a fixing device.

[1. Overall Structure of Image Forming Apparatus]

FIG. 1 is a diagram illustrating a structure of an image forming apparatus including a fixing device in accordance with the present embodiment. Referring to FIG. 1, an image forming apparatus 100 includes an outer cover 101 so as to cover the apparatus as a whole. A recording medium printed inside the apparatus is discharged from an exit port 108.

To form an image, image forming apparatus 100 shown here includes, for example, four photoconductors 104, each rotating, an intermediate transfer belt 105 onto which toner images formed at the respective transfer positions of photoconductors 104 are successively stacked and transferred, and a transfer roller 106 provided at a transfer position on a surface around which intermediate transfer belt 105 moves.

Then, a paper feed roller 103 transports a recording medium stored in a paper feed cassette 102 to the transfer position. Paper feed cassette 102 is provided with a not-shown sensor for detecting presence/absence of recording mediums, so that users are notified, for example, on a not-shown display panel, that paper feed cassette 102 is not set or that recording mediums run out.

In image forming apparatus 100, electrostatic latent images are formed on photoconductors 104 based on image data to be printed on a recording medium. Then, the electrostatic latent images formed on photoconductors 104 are developed into visual images by toner and then successively stacked on intermediate transfer belt 105. The toner images electrostatically transferred and combined on intermediate transfer belt 105 are electrostatically transferred collectively onto a recording medium through electrostatic suction by transfer roller 106. Then, after the transfer, the transfer paper (recording medium) is passed through fixing device 110, so that the image on the transfer paper is fixed by application of heat and pressure. Through this process, image formation completes. Thereafter, the recording member exits from exit port 108.

Figure 2:
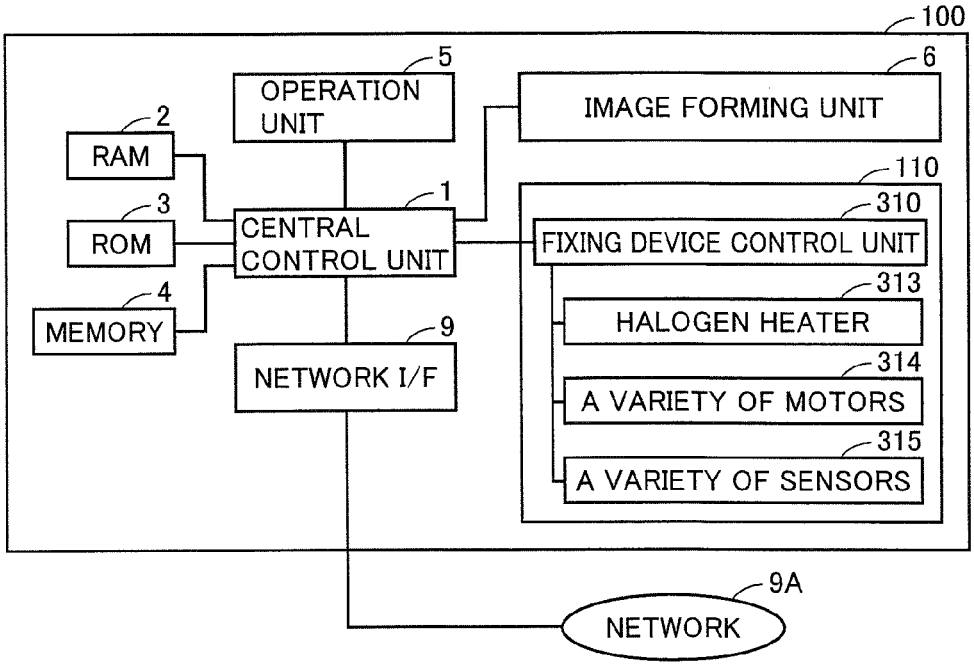
FIG. 2 is a block diagram of the image forming apparatus in FIG. 1.

FIG. 2 is a block diagram of image forming apparatus 100.

Referring to FIG. 2, image forming apparatus 100 includes a central control unit 1 for controlling the operation of image forming apparatus 100 as a whole. Central control unit 1 includes a CPU (Central Processing Unit).

Image forming apparatus 100 also includes a ROM (Read Only Memory) 3 including data such as a program executed by central control unit 1, a RAM (Random Access Memory) 2 serving as a working area when central control unit 1 executes a program, a memory 4 for storing a variety of data such as a set value used when central control unit 1 executes a program, an operation unit 5 including a display unit for displaying a state of image forming apparatus 100 and an input unit such as a button receiving external input of information, and a network I/F (interface) 9 serving as an interface for communication with an external device via a network 9A.

In image forming apparatus 100, an image forming unit 6 performs the process of forming and developing an electrostatic latent image, transferring a toner image onto a recording medium from paper feed cassette 102, and introducing the recording medium to fixing device 110, in the image forming operation including formation of an electrostatic latent image onto photoconductors 104, rotation of intermediate transfer belt 105, rotation of transfer roller 106, rotation of paper feed roller 103, processing of a sensor detection signal indicating presence/absence of recording mediums in paper feed cassette 102, as well as the process of ejecting the recording medium passed through fixing device 110 from exit port 108. The operation of image forming unit 6 is controlled by central control unit 1.

Fixing device 110 includes a fixing device control unit 310 for controlling the operation of fixing device 110 as a whole. In fixing device 110, fixing device control unit 310 controls operations of a halogen heater 313 and a variety of motors 314 based on detection outputs from a variety of sensors 315.

A control manner in fixing device 110 will be described later with further reference to FIG. 3 and FIG. 4.

[2. Structure of Fixing Device]

Figure 3:
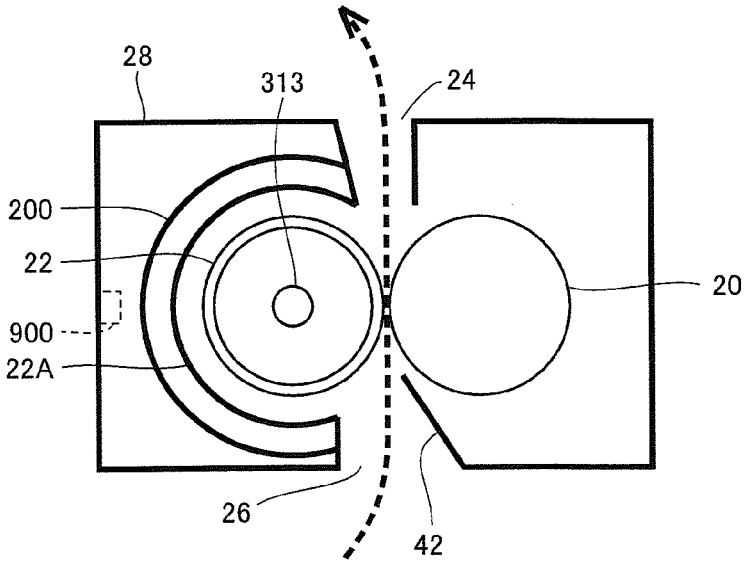
FIG. 3 is a diagram illustrating an internal structure of the fixing device in FIG. 1.

FIG. 3 is a diagram illustrating an internal structure of fixing device 110 in accordance with an embodiment of the present invention. FIG. 4 is a perspective view of fixing device 110.

Figure 4:
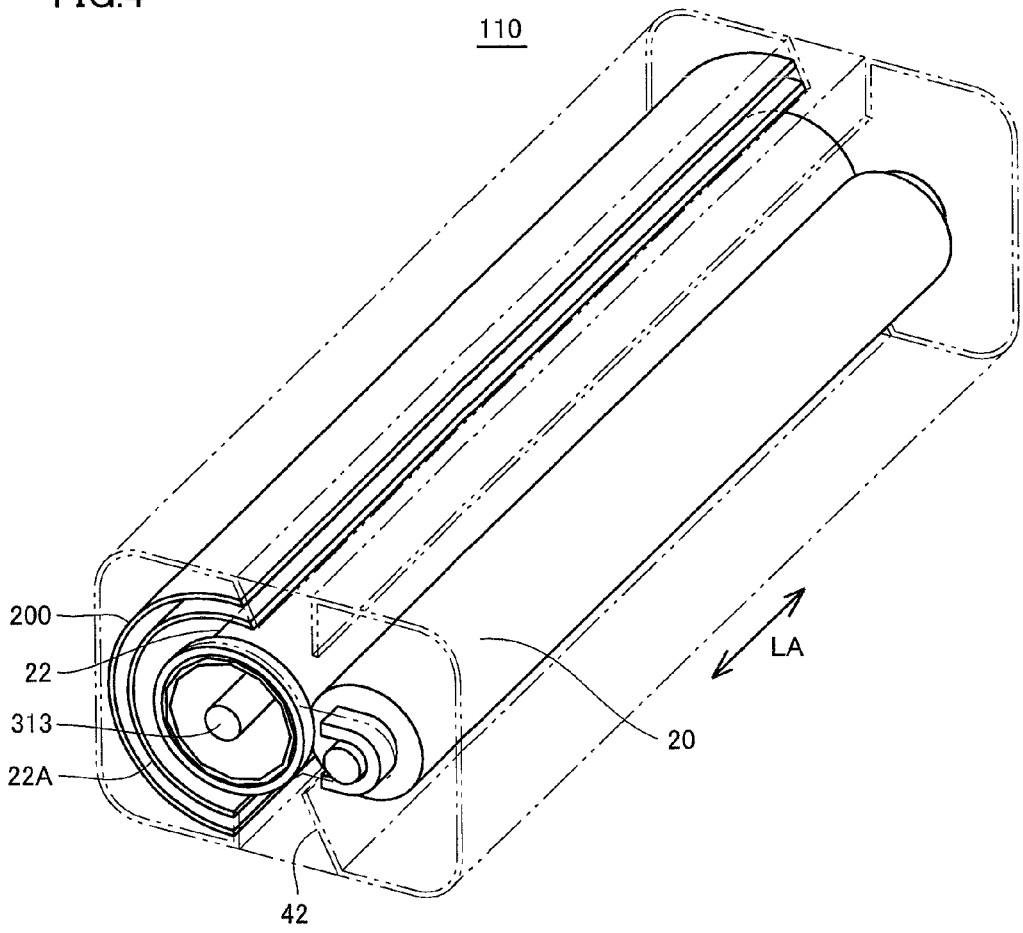
FIG. 4 is a perspective view of the fixing device in FIG. 1.

Referring to FIG. 3 and FIG. 4, fixing device 110 includes a casing 28, which covers the outside of fixing device 110. Fixing device 110 includes a discharge port 24 on the upper side of casing 28 (the downstream side along the direction in which a recording medium (paper) is transported), and a receiving port 26 on the opposite, lower side (the upstream side along the direction in which a recording medium is transported).

Receiving port 26 is provided with a guide member 42. If guide member 42 is structured to be driven by a driving mechanism, it may also function as a shutter for opening/closing receiving port 26.

In casing 28, provided are a heating roller (heating unit) 22 containing a halogen heater 313, and a pressing roller (pressing unit) 20.

The recording medium transported from receiving port 26 on the lower side of casing 28 is heated by heating roller 22 and pressed by pressing roller 20. Thus, a toner image on the recording medium is fixed on the recording medium. The recording medium is thereafter sent from discharge port 24 to the outside of fixing device 110.

In fixing device 110, the recording medium is in pressure contact with heating roller 22 and pressing roller 20 such that a nip region is formed. The nip region is formed such that no gap is produced in a region other than where the recording medium passes through.

Further referring to FIG. 2, fixing device 110 includes a not-shown temperature sensor (included in a variety of sensors 315) for detecting a surface temperature of heating roller 22. Fixing device control unit 310 controls the on/off of halogen heater 313 based on the temperature detected by the temperature sensor.

Fixing device control unit 310 also controls driving of a not-shown motor (included in a variety of motors 314), which allows heating roller 22 and pressing roller 20 to rotate in accordance with a timing at which a recording medium is introduced into fixing device 110.

Fixing device 110 includes a heat reflecting plate 200 between heating roller 22 and casing 28. Heat reflecting plate 200 is formed of a material (for example, aluminum) that reflects radiation heat from heating roller 22. It is noted that at least that surface of heat reflecting plate 200 which is opposed to heating roller 22 (with an intermediate member 22A being interposed, as described later) is formed of the above-noted material. In other words, heat reflecting plate 200 is formed of a member having an aluminum coating on the above-noted surface.

Fixing device 110 also includes intermediate member 22A between heating roller 22 and heat reflecting plate 200. Examples of materials of intermediate member 22A are aluminum, silver, and stainless steel, which have a relatively low emissivity. The entire intermediate member 22A may be formed of such a material. At least the surface that is opposed to heating roller 22 is coated with such a material.

Preferably, at least that surface of intermediate member 22A which is opposed to heating roller 22 is formed of a material having light reflecting performance for light of wavelengths corresponding to heat wave at the temperature (for example, 150° C. to 200° C.) at which heating roller 22 is heated in the fixing operation. Specifically, the material preferably has light reflecting performance for light of infrared wavelengths, for example, 2 μm to 10 μm. For example, the material may be aluminum, silver, or stainless steel.

Intermediate member 22A is preferably shaped like a plate which separates heating roller 22 from heat reflecting plate 200. Intermediate member 22A is provided, at least, so as to avoid scattering of toner, wax, or paper piece onto heat reflecting plate 200 from a recording medium passing over heating roller 22. In order to reliably avoid scattering of toner, etc. onto heat reflecting plate 200, intermediate member 22A preferably covers the entire area in the longitudinal direction (the direction shown by the double-headed arrow LA in FIG. 4) of heating roller 22 as well as the entire area of heat reflecting plate 200 that is opposed to heating roller 22 in the circumferential direction of heating roller 22, so that it entirely shields heat reflecting plate 200 from heating roller 22. However, intermediate member 22A can achieve the effect of preventing scattering of toner, etc. onto heat reflecting plate 200 as long as it covers at least part of heat reflecting plate 200 from heating roller 22.

[3. Action of Intermediate Member]

The action of intermediate member 22A in fixing device 110 in the present embodiment will be described with reference to FIG. 5A and FIG. 5B. FIG. 5B shows a state in which toner, wax, and paper pieces as noted above adhere to intermediate member 22A. Such adherents are shown as an adherent layer 22X. On the other hand, FIG. 5A shows a state in which such toner, wax, and paper pieces have not yet adhered to intermediate member 22A, for example, at the beginning of use of fixing device 110.

Figure 5A:
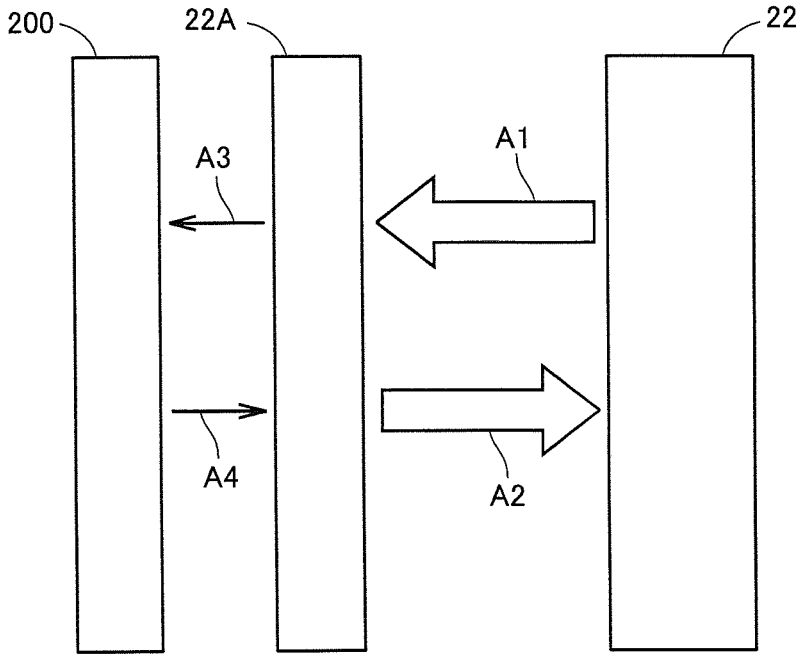
FIG. 5A and FIG. 5B are diagrams illustrating an action of an intermediate member in FIG. 3.
Figure 5B:
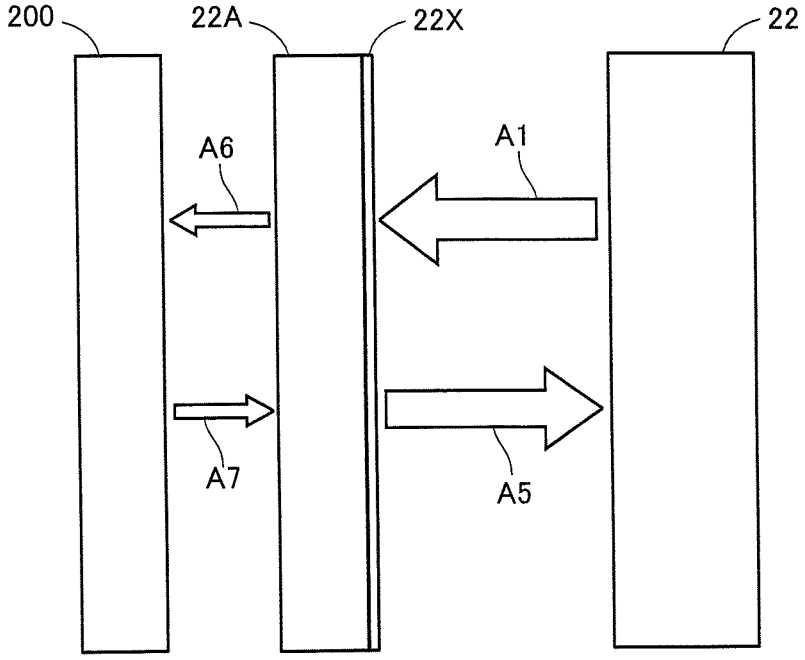

First, referring to FIG. 5A, in fixing device 110, heat is radiated from the surface of heating roller 22 toward intermediate member 22A as shown by arrow A1.

As described above, at least that surface of intermediate member 22A which is opposed to heating roller 22 is formed of a material having a relatively low emissivity. Accordingly, although part of the heat emitted from heating roller 22 is radiated toward heat reflecting plate 200 through intermediate member 22A as shown by arrow A3, most of the heat emitted from heating roller 22 is reflected by intermediate member 22A and returned to heating roller 22 as shown by arrow A2.

On the other hand, the heat radiated toward heat reflecting plate 200 is reflected by heat reflecting plate 200 and returned as shown by arrow A4.

Referring to FIG. 5B, when toner, etc. adheres to intermediate member 22A, the heat reflecting efficiency is reduced on the surface that is opposed to heating roller 22. Therefore, when heat is received from the surface of heating roller 22 as shown by arrow A1, the amount of heat reflected toward heating roller 22 is reduced as compared with when toner is not adhered (see FIG. 5A). However, since at least the surface of intermediate member 22A that is opposed to heating roller 22 is formed of a material having a relatively low emissivity, the amount of heat radiated toward heat reflecting plate 200 is increased as compared with when toner is not adhered (arrow A6).

In the present embodiment, the provision of intermediate member 22A avoids adhesion of toner, etc. to heat reflecting plate 200, as compared with when intermediate member 22A is not provided. Accordingly, even when toner, etc. adheres to intermediate member 22A as image forming apparatus 100 form images, the efficiency of reflecting heat radiated from intermediate member 22A is not reduced in heat reflecting plate 200. Therefore, the heat radiated from intermediate member 22A shown by arrow A6 is efficiently reflected toward intermediate member 22A (arrow A7) and is thereafter emitted toward heating roller 22.

In FIG. 5B, the heat radiated from intermediate member 22A toward heating roller 22 is shown by arrow A5. As described above, in the present embodiment, the heat radiated from intermediate member 22A toward heat reflecting plate 200 is reflected on the surface of heat reflecting plate 200 at a high efficiency and then returned toward intermediate member 22A. Accordingly, the heat radiated from heating roller 22 as shown by arrow A1 is returned from intermediate member 22A toward heating roller 22 at a relatively high probability, as shown by arrow A5.

Table 1 shows specific examples of power consumption and internal temperatures of casing 28 in image forming apparatus 100 at the initial stage as shown in FIG. 5A and at a stage after image formation on a recording medium as shown in FIG. 5B.

TABLE 1

| | | power consumption | housing temperature |
|---|---|---|---|
| without intermediate member | initial | 100% | 70° C. |
| | after endurance | 125% | 80° C. |
| with intermediate member | initial | 100% | 70° C. |
| | after endurance | 108% | 75° C. |

In Table 1, the examples in the case where intermediate member 22A is not provided are denoted with "without intermediate member," and the examples in the case where intermediate member 22A is provided as shown in FIG. 3 to FIG. 5B are denoted with "with intermediate member."

Furthermore, "initial" means the initial stage of image forming apparatus 100 as described above (a state in which image formation has not yet been carried out), and "after endurance" means a state in which image formation on recording mediums is carried out so sufficiently that toner, etc. adheres to intermediate member 22A and the like.

Furthermore, "power consumption" represents power consumed to stabilize halogen heater 313 at a temperature suitable for fixing images. For each of the case "without intermediate member" and the case "with intermediate member," power consumption at the stage "after endurance" is shown, given that power consumption at the "initial" stage is 100%. Power feed to halogen heater 313 is controlled by fixing device control unit 310.

The housing temperature refers to an internal temperature of casing 28 and shows, for example, a temperature detected by a temperature sensor 900 provided on the outside of heat reflecting plate 200 as shown by the broken line in FIG. 3.

In Table 1, the values for the cases "without intermediate member" and "with intermediate member" are measured for the image forming apparatus placed in a room at the same temperature. In both cases, "after endurance" shows a state after images are formed on the same number of recording mediums, starting from an "initial" stage.

As can be understood from Table 1, for the case "without intermediate member," the housing temperature, which is 70° C. at the "initial" stage, rises to 80° C. "after endurance." On the other hand, for the case "with intermediate member," the housing temperature "after endurance" is 75° C. This means that the provision of intermediate member 22A suppresses an increase in housing temperature. Such a difference of housing temperature arises presumably because the proportion of heat returned toward heating roller 22, of the heat radiated from heating roller 22, is smaller when intermediate member 22A is not provided than when it is provided. In other words, when intermediate member 22A is not provided, the adhesion of toner, etc. to the surface of heat reflecting plate 200 reduces the heat reflecting efficiency on the surface of heat reflecting plate 200, thereby increasing the housing temperature as compared with when intermediate member 22A is provided.

Furthermore, as can be understood from Table 1, power consumption "after endurance" is "125%" for the case "without intermediate member," whereas power consumption "after endurance" is limited to "108%" for the case "with intermediate member." The reason can be explained as follows. A larger proportion of heat radiated from heating roller 22 is returned to heating roller 22 when intermediate member 22A is provided than when it is not provided. Accordingly, the heat insulation efficiency in casing 28 is improved, so that the surface temperature of heating roller 22 is maintained at the same level with less power supplied to halogen heater 313.

In fixing device 110, the provision of intermediate member 22A between heating roller 22 and heat reflecting plate 200 improves the heat retention performance in casing 28 and maintains the heat reflecting efficiency of heat reflecting plate 200. Accordingly, power required by halogen heater 313 for heating can be reduced. Preferably, at least part of intermediate member 22A is arranged at a distance from heating roller 22 and heat reflecting plate 200. This is to prevent heat loss by heat conduction from intermediate member 22A to heating roller 22 or heat reflecting plate 200.

In accordance with the present embodiment, when toner, wax, etc. is scattered from a recording medium in pressure contact with the heating unit, the intermediate member provided on the side of the heating unit intercepts the toner, wax, etc. from the heat reflecting unit and prevents them from adhering to the heat reflecting unit. Therefore, a reduction of the heat reflecting efficiency can be avoided.

In addition, in accordance with the present embodiment, the provision of the intermediate member, rather than the provision of a cleaner with a complicated structure, prevents adhesion of toner, etc. to the heat reflecting unit, so that a reduction of the heat reflecting efficiency can be avoided while the production costs of the fixing device are kept low.

[4. Modification]

Figure 6:
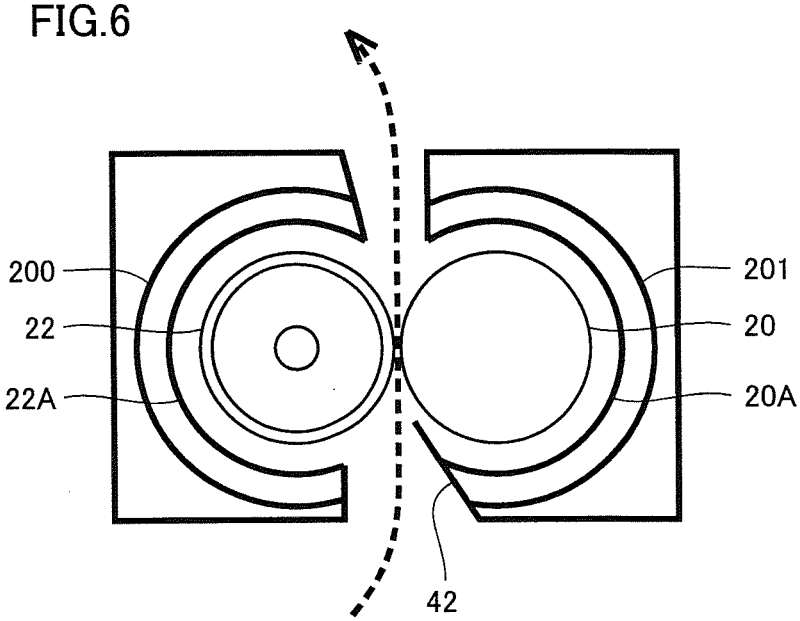
FIG. 6 is a diagram showing a modification of the fixing device in FIG. 3.

FIG. 6 shows a modification of the fixing device in accordance with the present embodiment.

A fixing device 110A shown in FIG. 6 differs from fixing device 110 illustrated with reference to FIG. 3, etc. in that it additionally includes an intermediate member 20A and a heat reflecting plate 201 on the outside of pressing roller 20 in casing 28.

The materials and structures of intermediate member 20A and heat reflecting plate 201 provided for pressing roller 20 can be similar to the materials and structures of intermediate member 22A and heat reflecting plate 200 provided for heating roller 22.

The modified embodiment not only prevents a reduction in temperature of heating roller 22 but also prevents a reduction in temperature of pressing roller 20 in abutment (directly or with a recording medium interposed) with heating roller 22. Accordingly, the heat retention efficiency in casing 28 can be improved, so that power consumption of fixing device 110A can be reduced more reliably.

In the modified embodiment, heat reflecting plate 201 is not simply provided alone, but heat reflecting plate 201 is provided together with intermediate member 20A, so that a reduction in temperature of pressing roller 20 can be avoided while the adhesion of toner, etc. to heat reflecting plate 201 is avoided. Accordingly, a reduction in temperature of pressing roller 20 can be avoided for a longer time.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A fixing device for fixing a toner image on a recording medium, comprising:

a heating unit for heating the recording medium;

a pressing unit for pressing the recording medium in pressure contact with said heating unit;

a casing for accommodating said heating unit and said pressing unit;

a first heat reflecting unit provided between said heating unit and said casing;

a first intermediate member provided between said heating unit and said first heat reflecting unit;

a second heat reflecting unit provided between said pressing unit and said casing; and a second intermediate member provided between said pressing unit and said second heat reflecting unit.

2. The fixing device according to claim 1, wherein at least part of said first intermediate member is at a distance from said heating unit and said first heat reflecting unit.

3. The fixing device according to claim 1, wherein that surface of said first intermediate member which is opposed to said heating unit is formed of a material capable of reflecting light of wavelengths of 2 to 10 μm.

4. An image forming apparatus for forming an image on a recording medium, said image forming apparatus comprising the fixing device according to claim 1.

5. The image forming apparatus according to claim 4, wherein at least part of said first intermediate member is at a distance from said heating unit and said first heat reflecting unit.

6. The image forming apparatus according to claim 4, wherein that surface of said first intermediate member which is opposed to said heating unit is formed of a material capable of reflecting light of wavelengths of 2 to 10 μm.

7. The fixing device according to claim 1, wherein opposite ends of the first intermediate member are each connected to the casing.

8. The fixing device according to claim 1, wherein at least one end of the first heat reflecting unit is connected to the casing and at least one end of the first intermediate member is connected to the casing.

9. The fixing device according to claim 1, wherein the first intermediate member possesses a semicircular cross section.

10. The fixing device according to claim 1, the second heat reflecting unit including a metallic surface facing the second intermediate member.

* * * * *